United States Patent [19]

Kirchhofer et al.

[11] Patent Number: 4,529,360

[45] Date of Patent: Jul. 16, 1985

[54] GAS DYNAMIC PRESSURE WAVE SUPERCHARGER FOR VEHICLE INTERNAL COMBUSTION ENGINES

[75] Inventors: Hubert Kirchhofer, Gebenstorf; Raymond Schelling, Baden, both of Switzerland

[73] Assignee: BBC Brown, Boveri & Company, Limited, Baden, Switzerland

[21] Appl. No.: 619,991

[22] Filed: Jun. 12, 1984

[30] Foreign Application Priority Data

Jun. 29, 1983 [CH] Switzerland ..... 3558/83

[51] Int. Cl.[3] ..... F04F 11/00

[52] U.S. Cl. ..... 417/64

[58] Field of Search ..... 417/64; 123/559; 60/39.45 A

[56] References Cited

U.S. PATENT DOCUMENTS 2,687,843 8/1954 Alcock ..... 417/64

*Primary Examiner*—Edward K. Look

*Attorney, Agent, or Firm*—Burns, Doane, Swecker & Mathis

[57] ABSTRACT

In a gas dynamic pressure wave supercharger for vehicle internal combustion engines, at least one of the two mutually facing end surfaces of the rotor and the air casing is made convex on the air casing side in order to maintain an axial clearance which increases radially from the inside to the outside. On the gas casing side, at least one of the two mutually facing end surfaces of the rotor and the gas casing is made concave in order to maintain an axial clearance which decreases in the cold condition radially from the inside to the outside. The concave or convex end surfaces can be formed as truncated cone surfaces or as spherical surfaces. By the appropriate shaping of the rotor and casing end surfaces, the thermal expansion and rotor vibrations are compensated and the supercharger can run with a small axial clearance and good efficiency.

5 Claims, 3 Drawing Figures

GAS DYNAMIC PRESSURE WAVE SUPERCHARGER FOR VEHICLE INTERNAL COMBUSTION ENGINES

BACKGROUND AND SUMMARY OF THE INVENTION

The invention concerns a gas dynamic pressure wave supercharger for internal combustion engines.

In pressure wave superchargers for supercharging vehicle internal combustion engines, the problem of the axial clearances between the rotor end surfaces and the casing end surfaces facing the rotor is of great importance. The efficiency and the operating behaviour of a pressure wave supercharger depend very strongly on these axial clearances. Satisfactory operation of the pressure wave supercharger and good efficiency can only be obtained using very small axial operating clearances because the leakage losses at the end faces of the rotor are then minimized. However, the rotor must be simultaneously prevented from touching the casing end surfaces. Because thermal expansion does not displace the end surfaces simply in parallel planes, this danger cannot be dealt with by larger fitting clearances alone. To this problem must be added the danger of rubbing occurring between the rotor and the casing end surfaces facing it because of rotor vibrations.

In order to avoid rotor damage due to possible heavy contact, an abradable layer, for example a graphite/-nickel layer, can be applied to the casing or rotor end surfaces, or an abrasive fine grain $AL_2O_3$ (corundum base) layer can be applied to the casing end surfaces.

The rubbing layer is only abraded in the radial region of the relatively sharp-edged cell walls. The layer in the region of the thick hub tube is merely compressed, which can lead to the rotor becoming jammed in the case of severe rubbing. Due to ageing of the layer, the latter can flake off and hence lead to poor efficiency of the pressure wave supercharger. In addition, the rubbing layer applied by a flame-spray method is too expensive for mass production of a pressure wave supercharger.

The object of the invention is to produce a gas dynamic pressure wave supercharger, of the first type mentioned. The rotary and casing end surfaces of the supercharger avoids rubbing layers and is optionally shaped with respect to thermal expansion and rotor vibrations, guaranteeing satisfactory operation of the pressure wave supercharger.

The supercharger comprises a rotor located between an air casing and a gas casing. The rotor end surfaces are each separated by an axial clearance from the casing end surface facing the rotor. On the air casing side, at least one of the two mutually facing end surfaces of the rotor and the air casing is convex. The shape serves to maintain an axial clearance when the motor operates from a cold startup. Alternatively, on the gas casing side of the rotor at least one of the two mutually facing end surfaces may be concave.

The advantages obtained by means of the invention may be seen essentially in that the thermal expansion and rotor vibrations are so compensated by appropriate shaping of the rotor and casing end surfaces that it is possible to operate with very small axial clearances and hence with a good efficiency.

The same parts are provided with the same reference signs in the figures. Parts of the pressure wave supercharger/engine system which are unimportant to the invention, such as the air induction pipe, the supercharged air pipe, the engine outlet gas pipe and the exhaust pipe, are omitted. The flow directions of the working media are indicated by arrows.

DETAILED DESCRIPTION OF THE PREFERRED EMBODIMENT

The fundamental construction of a pressure wave supercharger and its precise structure can be taken from the applicant's Swiss Pat. No. 123,143.

Figure 1:
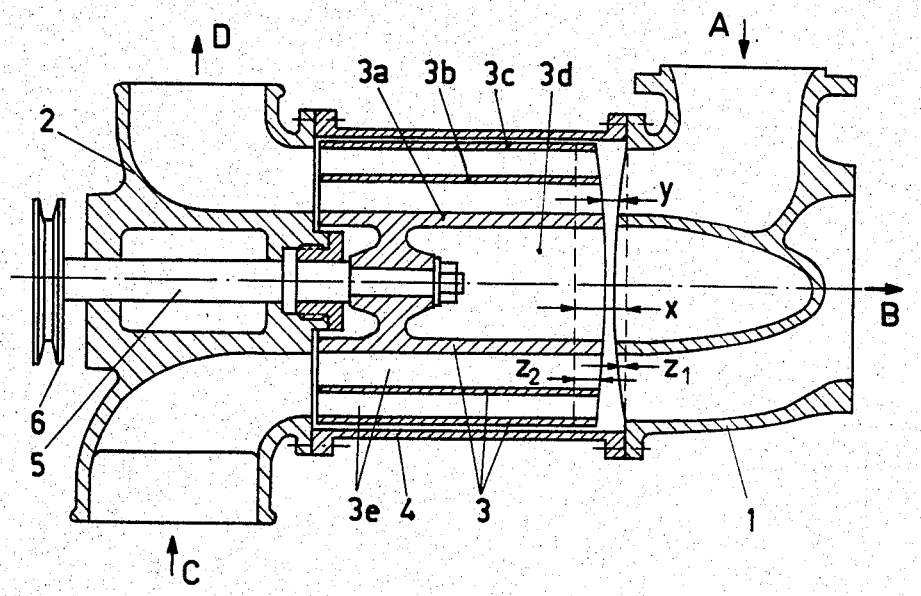
FIG. 1 shows, in longitudinal section, a pressure wave supercharger of the current state of the art, the heat deformation of the gas side end faces of the rotor and casing end being shown on an enlarged scale.

In FIG. 1, the gas casing of the pressure wave supercharger is indicated by 1 and the air casing by 2. The two casings are connected together by means of the stator central part 4, in which is located the rotor 3. The rotor 3 is fastened on the shaft 5 and supported in the air casing 2. A V-belt pulley 6 is located on the shaft 5. The hot exhaust gases of the internal combustion engine enter the rotor 3 of the pressure wave supercharger from the motor exhaust gas duct A, the rotor 3 being provided with straight axial rotor cells 3*e* open on both sides. The exhaust gases expand in the rotor and are released to atmosphere via the exhaust duct B and the exhaust pipe, which is not shown. On the air side, atmospheric air is induced, flows via the air induction duct C axially into the rotor 3, where it is compressed and expelled as supercharged air via the supercharged air duct D to the internal combustion engine, which is not shown.

In order to understand the actual gas dynamic pressure wave process, which is extremely complex and not the subject of the invention, reference should be made to the applicant's previously cited Swiss Pat. No. 123,143.

The process necessary for understanding the invention is briefly described below:

The pressure wave processes take place within the rotor 3. Their main effect is to form a gas filled space and an air filled space. In the former, the exhaust gas expands and then escapes into the exhaust duct B while, in the second space, part of the induced fresh air is compressed and expelled through the supercharged air duct D. The residual proportion of fresh air is spilled by the rotor 3 into the exhaust duct B and, by this means, causes complete scavenging of the exhaust gas.

In order to maintain good pressure wave supercharger efficency, it is necessary to keep the axial clearances between the rotor end surfaces and the corresponding casing end surfaces as small as possible at all diameters.

The axial installation clearance can be measured externally using the rotor shroud. It must be sufficiently large for the rotor not to rub in the hub region during operation.

The thermal expansion behaviour of the rotor and the central part of the stator varies widely with the individual operating conditions. The most critical with respect to the danger of rubbing is the transient behaviour of the clearance during a startup of a cold motor and subsequent rapid acceleration to full load and maximum rotational speed of the internal combustion engine.

During the operation of a pressure wave supercharger, relative deformations of the casing and rotor end surfaces also appear, particularly on the gas side, due to uneven temperature distribution on the gas casing end surfaces in both the peripheral direction (high pressure zone/low pressure zone) and the radial direction.

The rotor has a relatively thick hub tube 3*a*, a thin intermediate tube 3*b* and a thin external shroud 3*c*. In pressure wave machines for motor vehicle internal combustion engines, the rotor 3 is usually subjected to continuous temperature fluctuations during alterations to load and rotational speed. Because of the larger heat capacity of the hub tube 3*a*, this has, on the average, a higher temperature than the outer shroud 3*c*. This causes a larger thermal expansion of the hub tube 3*a* relative to the outer shroud 3*c*. Due to ventilation and heat radiation, the outer shroud 3*c* emits more heat in an outwards direction than the hub tube 3*a*. In addition, the heat rejection in the hub space 3*d* leads to a build-up of heat. The larger thermal expansion of the hub tube 3*a* leads, during operation, to axial deformation, particularly of the gas side rotor end surfaces. Due to the different thermal expansion at different radii, the rotor end surface facing towards the gas casing and the gas casing end surface facing towards the rotor will acquire a convex shape so that the axial clearance increases with increasing radius. On the air side, the relative heat deformation is negligible between the rotor 3 and the end surfaces of the air casing 2 facing the rotor. In FIG. 1, an axial clearance in the cold condition of a pressure wave supercharger of the current state of the art is shown, exaggerated and not to scale, at X. The radius-dependent axial clearance Y at the operating temperature of the pressure wave supercharger is, inter alia, a function of the temperature distribution in the rotor and in the gas casing. The radius-dependent drformation $Z_2$ of the rotor and deformation Z, of the gas casing depend on both the temperature and the thermal expansion coefficient of the material used.

In addition, rotor vibrations (wobbling motions) occur due to the asymmetric suspension of the rotor 3 on shaft 5. These asymmetries are important in dimensioning the axial clearance distribution on both the air side and the gas side.

Figure 2:
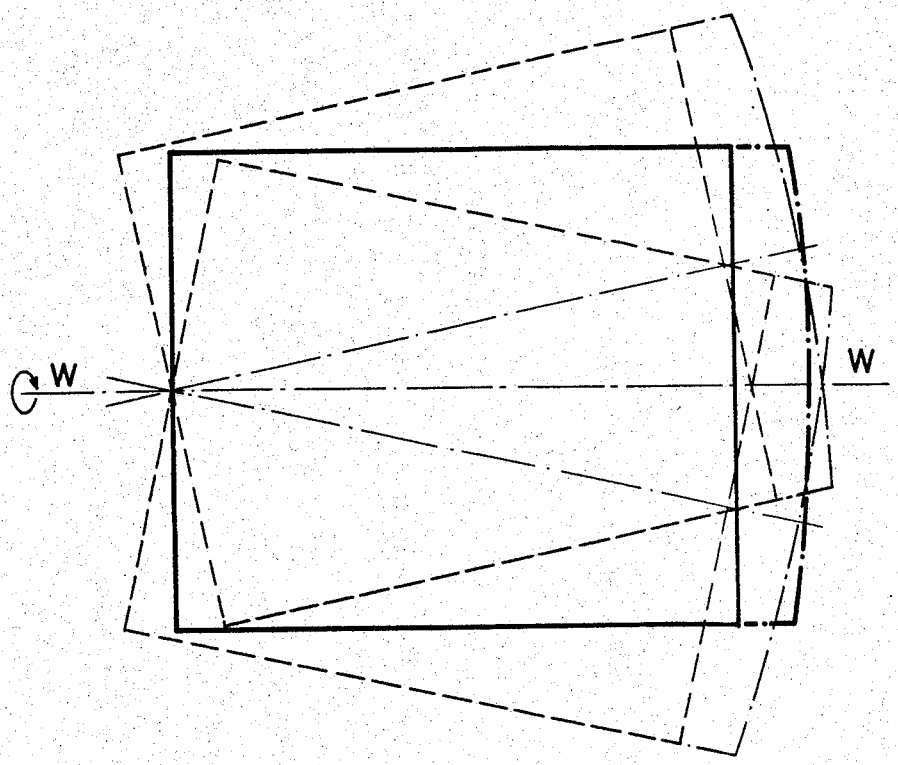
FIG. 2 shows a diagrammatic representation of vibrations and thermal expansions of the rotor of a pressure wave supercharger.

In FIG. 2, the neutral position of the rotor of a pressure wave supercharger is diagrammatically represented by a full line, the line W—W indicating the axis of rotation. The left rotor end shown in the diagram is the air casing end. Since the fastening point of the rotor on the shaft 5 is in the vicinity of the relatively colder air casing, the rotor expands mainly in the direction of the gas casing. Since the inner part of the rotor is hotter than the outer part, the gas side of the rotor end face deforms into a convex shape at the same time. This deformation is indicated by a chain-dotted line. The radial thermal expansion is here neglected. Due to the asymmetric support of the rotor, already mentioned, rotor vibrations occur in operation as indicated in FIG. 2 by dotted lines. These vibrations must be taken into account in deciding the profile of the rotor and casing end surfaces in order to obtain the smallest possible axial operating clearances.

To this extent, the pressure wave supercharger is known. In accordance with the invention, at least one of the two mutually facing end surfaces of the rotor and the air casing is now shaped convex on the air casing side and/or at least one of the two mutually facing end surfaces of the rotor and of the gas casing is shaped concave on the gas casing side. By this means, an axial clearance increasing radially from the inside to the outside is attained in the cold condition on the air casing side and an axial clearance decreasing radially from inside to outside in the cold condition is attained on the gas casing side. The convex or concave end surfaces are designed as either truncated cone surfaces or spherical surfaces or as two or more truncated cone surfaces in series with varying cone angles. It is advantageous if the matching angle a on the rotor end surface facing the gas casing or the matching angle b on the gas casing end surface facing the rotor is between 10° and 30°.

Figure 3:
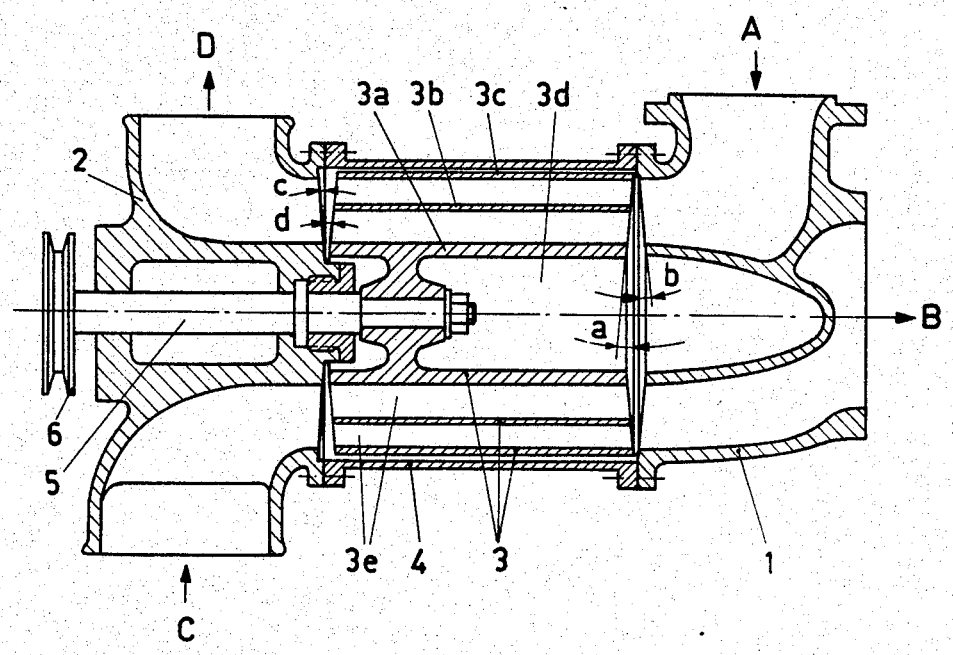
FIG. 3 shows an embodiment in accordance with the invention of a pressure wave supercharger in longitudinal section.

In the pressure wave supercharger in accordance with the invention shown in the cold condition in FIG. 3, both the rotor end surfaces and the casing end surfaces are machined as truncated cone surfaces in such a way that the smallest possible axial clearances are obtained in the operating condition of the pressure wave supercharger. Rubbing of the rotor is, nevertheless, made impossible. Both thermal expansions and mechanical rotor vibrations are taken into account in this process. The machining angles a, b, c and d are here shown exaggerated and not to scale for better clarity. If only one of the gas side end surfaces is machined as a truncated cone surface, for example the end surface of the gas casing 1 facing the rotor 3, the machining angle b is, in this case, preferably between 10° and 30°. If both the end surfaces facing towards one another on the gas side are machined as truncated cone surfaces, the two machining angles a and b are preferably 5° to 15° each.

Using the accurately measured temperature fields and the vibration amplitudes, the necessary profiles for the rotor and casing end surfaces can be exactly calculated. These profiles can also be determined by tests. For this purpose, graphite pins can be inserted in the gas and air casing end surfaces. The graphite pins are ground away by the rotor during hot operation of the pressure wave supercharger on the test stand. The optimum shape of the end surfaces can be determined by measuring the residual lengths of the pins. When the necessary axial clearances between the rotor and the air or gas casings have been determined, a decision on whether the radial distribution of the necessary axial clearance should be obtained by machining the rotor and/or casing end surfaces can be made from a cost comparison. Whether the casing end surface should also be profiled in the peripheral direction, i.e. whether it should be machined as a rotationally asymmetrical surface, is a question of optimisation, for which the extra machining costs should be compared with the gain in efficiency.

The principles, preferred embodiments and modes of operation of the present invention have been described in the foregiong specification. The invention which is intended to be protected herein should not, however, be construed as limited to the particular forms described, as these are to be regarded as illustrative rather than restrictive. Variations and changes may be made by those skilled in the art without departing from the spirit of the present invention. Accordingly, the foregoing detailed description should be considered exemplary in nature and not limiting to the scope and spirit of the invention as set forth in the appended claims.

What is claimed is:

1. A gas dynamic pressure wave supercharger for supercharging an internal combustion engine, comprising a rotor located between an air casing and a gas casing, the rotor being supported in the air casing, each end surface of the rotor separated by an axial clearance from end surfaces of the casings facing the rotor, wherein on the air casing side, at least one of the end surfaces of the rotor and the air casing has a convex shape to maintain an increasing axial clearance radially from the inside to the outside when the engine is cold; and, on the gas casing side at least one of the facing end surfaces is concave to maintain a decreasing axial clearance radially from the inside to the outside when the engine is cold.

2. The gas dynamic pressure wave supercharger of claim 1, comprising convex and concave end surfaces shaped as truncated cone surfaces.

3. The gas dynamic pressure wave supercharger of claim 1, comprising spherically shaped convex and concave end surfaces.

4. The gas dynamic pressure wave supercharger of claim 1, wherein the convex and concave end surfaces that are formed from two truncated cone surfaces have different cone angles.

5. The gas dynamic pressure wave supercharger of claim 2, wherein at least one of a machining angle on the rotor end surface facing the gas casing and the angle on the gas casing end surface facing the rotor is between 10° and 30°.

* * * * *